US006773141B2

(12) United States Patent
Zhao et al.

(10) Patent No.: US 6,773,141 B2
(45) Date of Patent: Aug. 10, 2004

(54) PROTECTED COATING FOR ENERGY EFFICIENT LAMP

(75) Inventors: Tianji Zhao, Mayfield, OH (US); Rajasingh Schwartz Israel, Westlake, OH (US); Frederick Walter Dynys, Chagrin Falls, OH (US); Thomas Gene Parham, Livermore, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/098,772

(22) Filed: Mar. 14, 2002

(65) Prior Publication Data

US 2002/0126487 A1 Sep. 12, 2002

Related U.S. Application Data

(62) Division of application No. 09/471,354, filed on Dec. 23, 1999.

(51) Int. Cl.[7] ..... H01J 3/16

(52) U.S. Cl. ..... 362/257; 362/635; 362/296; 362/310; 362/341; 362/343

(58) Field of Search ..... 362/257, 635, 362/296, 310, 341, 343, 516; 313/635, 112, 113, 479, 110; 428/544, 673, 75; 359/884, 883, 514; 427/125, 123

(56) References Cited

U.S. PATENT DOCUMENTS 3,010,045 A 11/1961 Plagge et al.
3,687,713 A 8/1972 Adams
4,009,947 A * 3/1977 Nishida et al. ..... 350/288
4,160,929 A * 7/1979 Thorington et al. ..... 313/112
4,211,803 A 7/1980 Cowher et al.
4,238,704 A * 12/1980 Bonk et al. ..... 313/113
4,272,588 A 6/1981 Yoldas et al.

(List continued on next page.)

OTHER PUBLICATIONS

D.K. Burge, et al., "Effect of Atmospheric Exposure on the Infrared Reflectance of Silvered Mirrors With and Without Protective Coatings," Applied Optic, vol. 12, No. 1, pp. 42–47, (1973).

(List continued on next page.)

*Primary Examiner*—Sandra O'Shea
*Assistant Examiner*—Anabel Ton
(74) *Attorney, Agent, or Firm*—Fay, Sharpe, Fagan, Minnich & McKee, LLP

(57) ABSTRACT

A reflector lamp has a generally parabolic shaped housing (12) with an interior surface coated with a layer (14) of silver having a protective layer (16) of a stable protective oxide, such as silica, disposed thereon. An intermediate layer (18), such as a layer of elemental silicon, protects the silver layer during deposition of the silica layer and is completely or substantially consumed during formation of the silica layer. The lamp includes a light source (48) having a longitudinal axis (x) disposed on the parabolic reflector axis and preferably disposed outward of the parabolic focus (F). During lamp fabrication, the protective coating is preferably annealed to improve reflectance. The preferred lamp will have a lumens per watt greater than 14.

20 Claims, 5 Drawing Sheets

U.S. PATENT DOCUMENTS

| | | | | | |
|---|---|---|---|---|---|
| 4,346,324 | A | | 8/1982 | Yoldas | |
| 4,425,606 | A | | 1/1984 | Shanks et al. | |
| 4,435,445 | A | | 3/1984 | Allred et al. | |
| 4,448,855 | A | | 5/1984 | Senaha et al. | |
| 4,467,238 | A | | 8/1984 | Silverstein et al. | |
| 4,482,209 | A | | 11/1984 | Grewal et al. | |
| 4,508,054 | A | | 4/1985 | Baumberger et al. | |
| 4,547,432 | A | | 10/1985 | Pitts et al. | |
| 4,685,110 | A | | 8/1987 | DeBell et al. | |
| 4,701,663 | A | | 10/1987 | Kawakatsu et al. | |
| 4,959,583 | A | | 9/1990 | Arsena et al. | |
| 4,987,343 | A | | 1/1991 | Kosmatka et al. | |
| 5,076,663 | A | | 12/1991 | Arendt et al. | |
| 5,143,445 | A | | 9/1992 | Bateman et al. | |
| 5,177,396 | A | | 1/1993 | Gielen et al. | |
| 5,440,469 | A | * | 8/1995 | Gomes | 362/226 |
| 5,825,565 | A | | 10/1998 | Papenburg et al. | |
| 6,146,002 | A | | 11/2000 | Danapilis et al. | |
| 6,310,737 | B1 | * | 10/2001 | Gillich et al. | 359/883 |
| 6,416,194 | B1 | * | 7/2002 | Demiryont | 359/883 |

OTHER PUBLICATIONS

Gulino, et al., "Chemical Vapor Deposited Silica Coatings for Solar Mirror Protection," Prepared for 26th Aerospace Sciences Meeting sponsored by the American Institute of Aeronautics and Astronautics, Reno, Nevada, pp. 1–8, (Jan. 1988).

G. Hass, et al., "Reflectance and durability of Ag mirrors coated with thin layers of $Al_5O_3$ plus reactively deposited silicon oxide," Applied Optics, vol. 14, No. 11, pp. 2639–2644 (1975).

Elvedin Sirbegovic et al., "An Investigation of the durability of front surface Ag mirrors using oxide protecting layers," Vacuum, vol. 43, No. 5–7, pp. 763–765 (1992).

P. Hollingsworth Smith and H. Gurev, "Slicon Dioxide as a High Temperature Stabilizer for Silver Films*," *Thin Solid Films*, 45, pp. 159–168 (1977).

* cited by examiner

PROTECTED COATING FOR ENERGY EFFICIENT LAMP

This is a divisional of application Ser. No. 09/471,354, filed Dec. 23, 1999 entitled PROTECTED COATING FOR ENERGY EFFICIENT LAMP.

BACKGROUND OF THE INVENTION

This invention relates to the lamp arts. More particularly, this invention relates to a reflector coating and a method of preparation thereof for use in reflector lamps wherein a light source is contained in a housing having a transparent section and a reflective section, the reflective section being positioned to reflect a preponderance of generated light through the transparent section.

The reflector lamps of the present invention are particularly well suited for use in spot lighting, head lamps, and the like. Examples of typical reflector lamps include General Electric's PAR 38 and PAR 64 lamps. PAR is the commonly accepted acronym for "parabolic aluminized reflector". Other commercially available reflector lamps may also benefit from aspects of the present invention. U.S. Pat. Nos. 3,010,045; 4,021,659; 4,804,878; 4,833,576; 4,855,634; and, 4,959,583 describe reflector lamps and methods of their manufacture, many of which may be modified in accordance with this invention.

A recent area of emphasis in reflector lamp design has been to increase energy efficiency. Energy efficiency is typically measured in the industry by reference to the lumens produced by the lamp per watt of electricity input to the lamp (LPW). Obviously, a lamp having high LPW is more efficient than a comparative lamp demonstrating a low LPW. In this regard, it is expected that governmental regulations will require a significant improvement in reflector lamp LPW in the near future.

One of the most commonly used reflector coatings is aluminum film, which is deposited on the surface of a reflector by thermal evaporation and sputtering. Manufacture costs are low and the film is stable at lamp operating temperatures over the life of the lamp. Reflectivities of the film in the visible spectrum are such that PAR 38 lamps incorporating the aluminum films are able to convert about 70% of the light emitted from the lamp filament tube to luminous output.

Silver films have a higher reflectivity and are used in optics, electronics, and in lighting. For the same PAR 38 example, silver-coated lamps are able to convert about 80–85% of the light emitted from the lamp filament tube to luminous output, a 15% lumen gain is thus expected.

Conventional manufacturing methods for assembling lamps with aluminum films incorporate several high temperature processes, including pre-heating, tubulating, aluminizing, brazing, and sealing. In the preheating step, the reflector is heated to about 800° C. In the tubulating step, ferrules and an exhaust tube are welded to the base of the reflector. The reflector is then aluminized to provide the aluminum coating. Brazing involves the welding of light source to the ferrules. In the sealing step, a transparent cover lens is sealed over the reflector opening. Typically, an open natural gas and oxygen flame is used to carry out many of these heating steps. The flame heats adjacent portions of the reflector to high temperatures. In sealing, for example, the reflector and coating are subjected to a temperature of around 1000° C. in the seal region, and around 650° C. away from the seal.

Silver films may be prepared in a similar manner to the aluminum films. However, evaporated or sputtered silver films are notoriously unstable at temperatures in excess of 200 degrees Celsius. Silver films are readily oxidized at the temperatures used in sealing and the optical properties of the films destroyed. Unprotected silver films are thus unsuited to lamp manufacture by such processes. Moreover, the films exhibit poor chemical resistance to sulfide tarnishing, and thus the properties of the unprotected films are destroyed on exposure to the atmosphere.

Protective coatings of silicon dioxide on silver films are known for mirrors in optical applications. However, when sputtering is used to form a silicon dioxide film, oxygen introduced to the vacuum chamber for formation of the silicon dioxide film may take its ion form due to the high electric field within the chamber. The oxygen ions tend to attack the silver film prior to deposition of the silicon dioxide coating. As a result, the silver film becomes oxidized and its high reflectivity is lost. In extreme cases, the silver film becomes blackened and thus ineffective.

Another problem with forming silicon dioxide films on silver is that the silicon dioxide film, as deposited, is oxygen deficient (i.e., has a composition $SiO_x$, where $1 \leqq x \leqq 2$). The refractive index of $SiO_x$ is larger than that of $SiO_2$. Such oxygen deficient $SiO_2$ on the silver film reduces the reflectivity of the protected silver film. As a result, the lumen output decreases.

Accordingly, there is a need in this art to develop a more energy efficient reflector lamp, which maintains acceptable light temperatures, light colors, life, and compatibility with current hardware.

SUMMARY OF THE INVENTION

In an exemplary embodiment of the present invention, a method of forming a lamp is provided. The method includes providing a reflective interior surface, consisting of the steps of providing a layer of silver, providing a protective layer which protects the silver layer against oxidation and sulfide formation, and providing a buffer layer intermediate between the layer of silver and the protective layer which protects the silver layer from oxidation during the step of providing the protective layer. The method further includes forming the lamp from the interior surface, a light source and a lens.

In another exemplary embodiment of the present invention, a lamp is provided. The lamp includes a light source within a housing having a reflective interior surface consisting of a protective layer disposed over a layer of silver. The lamp is produced by a method which includes annealing the reflective surface to increase its reflectivity.

In another exemplary embodiment of the present invention, a lamp is provided. The lamp includes a housing, a light source within the housing. A reflective interior surface includes a silver layer, a protective layer disposed over the silver layer. A lens closes the housing.

In another exemplary embodiment of the present invention, a lamp is provided. The lamp includes a light source within a generally parabolic housing having a reflective interior surface comprising a protective layer covering a silver layer. The light source has a longitudinal axis disposed substantially on the axis of said parabolic housing.

One advantage of this invention is the provision of a new and improved reflector lamp having superior LPW.

Another advantage of the present invention is the provision of a protective coating on a silver reflector.

Another advantage of the present invention is the provision a stoichiometric silicon dioxide coating with high reflectivity.

Additional advantages of the invention will be set forth in part in the description, which follows and in part will be obvious from the description, or may be learned by practice of the invention. The objects and advantages of the invention may be realized and attained by means of the instrumentalities and combinations particularly pointed out in the appended claims.

DETAILED DESCRIPTION OF THE INVENTION

Reference will now be made in detail to the present preferred embodiment of the invention, an example of which is illustrated by the accompanying drawings. while the invention will be described in connection with a preferred embodiment, it will be understood that it is not intended to limit the invention to that embodiment.

On the contrary, it is intended to cover all alternatives, modifications and equivalents as may be included within the spirit and scope of the invention defined by the appended claims.

Figure 1:
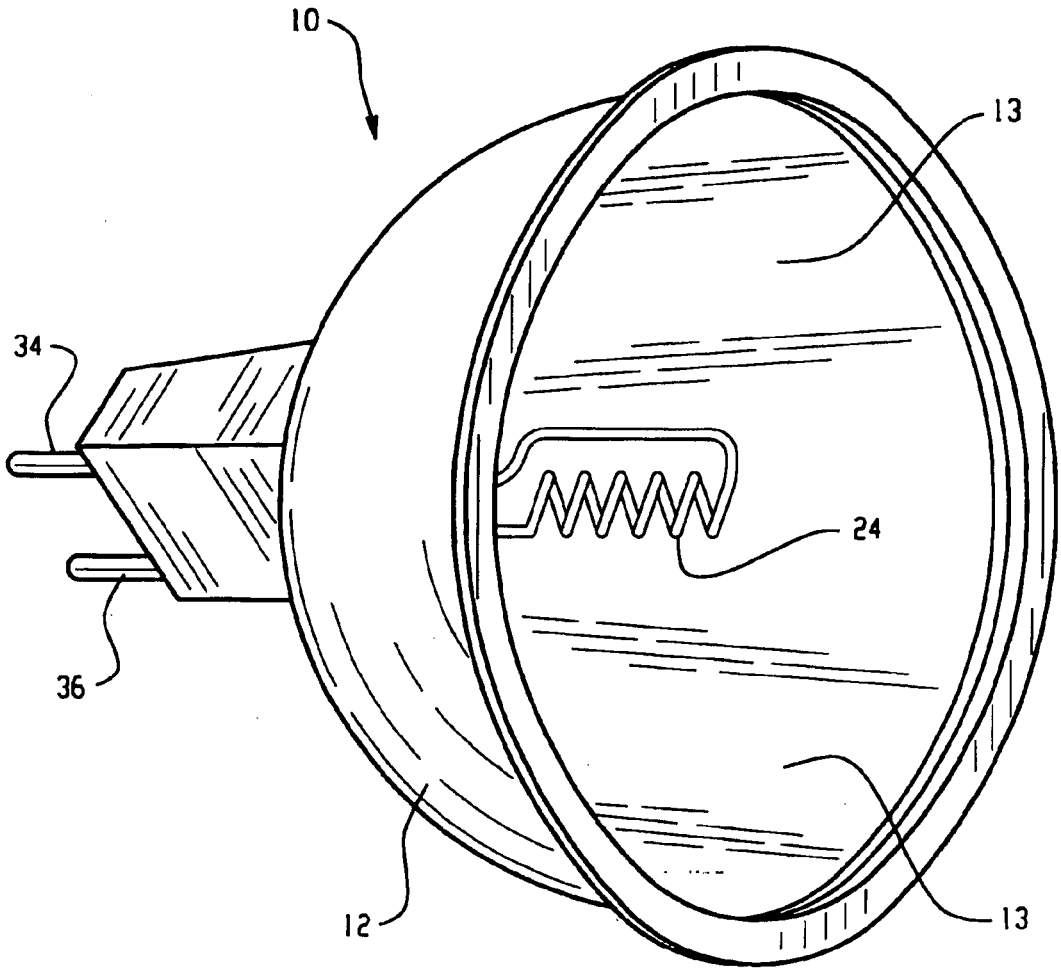
FIG. 1 is a perspective view of an assembled incandescent lamp in accordance with the teachings of the invention.
Figure 2:
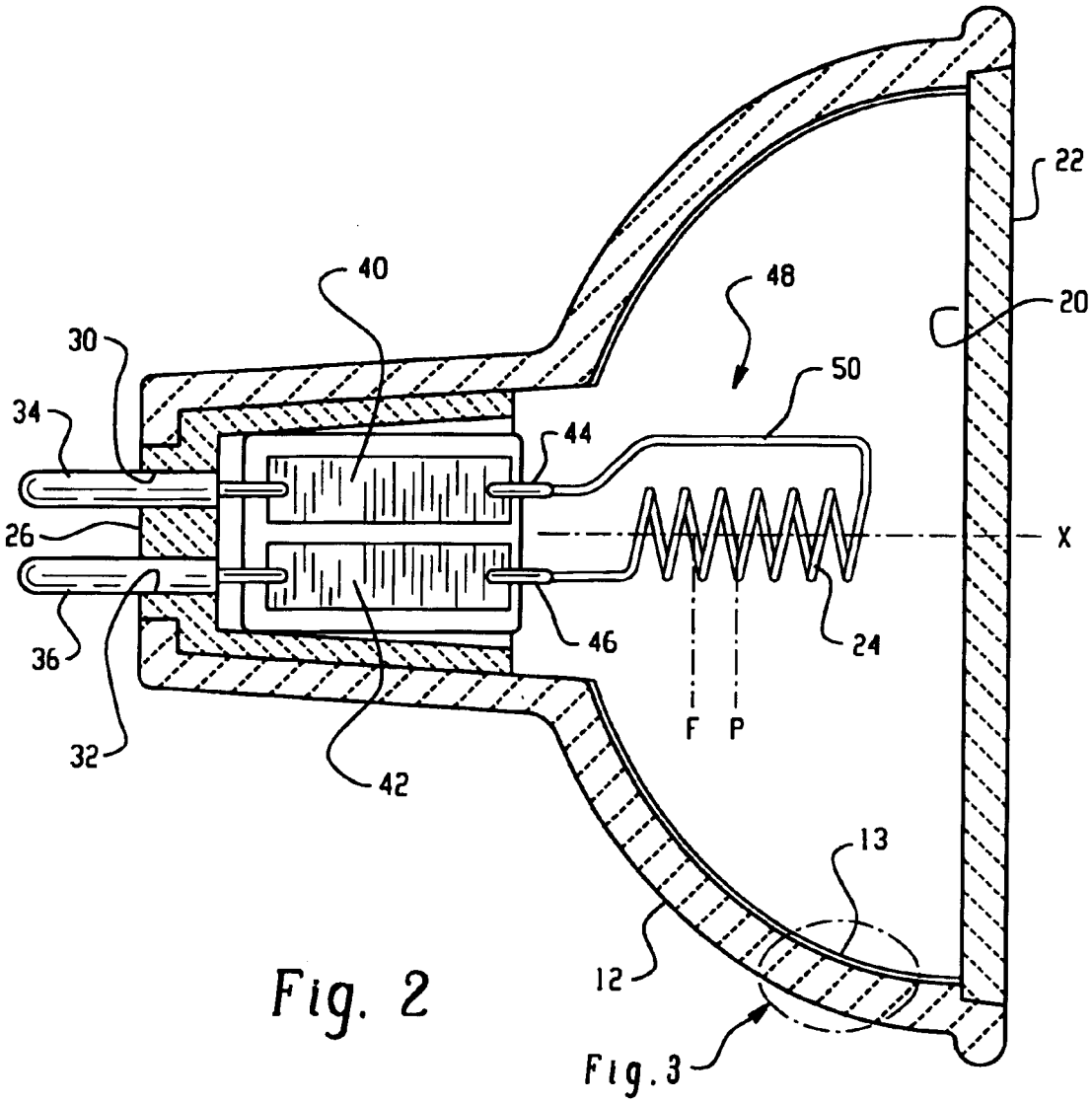
FIG. 2 is a cross-section of the lamp of FIG. 1.
Figure 3:
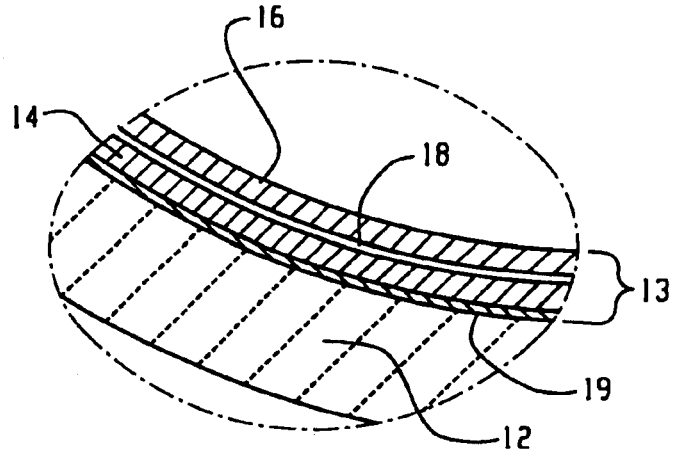
FIG. 3 is an enlarged side sectional view of a portion of the reflector of the lamp of FIG. 2 illustrating the reflective coating of the present invention; and, FIG. 4 is a partial cross-sectional view of a prior art halogen lamp.

Referring now to the FIGS. 1–3, a lamp 10 comprises a parabolic shaped reflector housing 12 including an interior coating 13 of a first, inner layer of silver 14 and a second, outer layer 16 of a protective material, such as a stable oxide. Suitable protective materials include, but are not limited to, silica ($SiO_2$), titanium dioxide ($TiO_2$), and aluminum oxide ($Al_2O_3$). Intermediate between the inner and outer layers is optionally a third, or buffer layer 18. Suitable materials for the buffer layer include silicon, titanium, tantalum, and the like, alone or in combination.

Optionally, an additional layer 19 is interposed between the silver layer 13 and the housing 12, such as a layer of chromium or nickel. Such an additional layer may be used to improve the adherence of the silver coating to the quartz or glass surface of the housing. or, the layer 19 may be used for other purposes, such as increasing the thickness of the reflective film to minimize the occurrence of pinhole openings in the film which allow light through to the rear of the housing.

The reflector housing 12 includes a first end having an opening 20 sealed with a lens 22. Lens 22 may be transparent to all light, may include a filter to absorb/reflect the light dispersed by a filament 24, and may include an anti-reflection coating to enhance light transmission. In fact, lens 22 may be designed, as known in the art, to meet the particular requirements of the lamp.

A second end 26 of reflector housing 12 includes two pass-through channels 30 and 32, which accommodate leads or ferrules 34 and 36. Leads 34 and 36 are in electrical connection with foils 40 and 42, which in turn are in electrical connection with leads 44 and 46. In this manner, electricity is provided to a light source 48, comprising a filament support 50 and the filament 24. As is apparent, the longitudinal axis x of filament 24 lies on the axis of parabolic reflector housing 12. It is also apparent that the midpoint P of the longitudinal axis of the filament 24 lies between the lens 22 and the focus F of the parabolic reflector housing 12.

Figure 4:
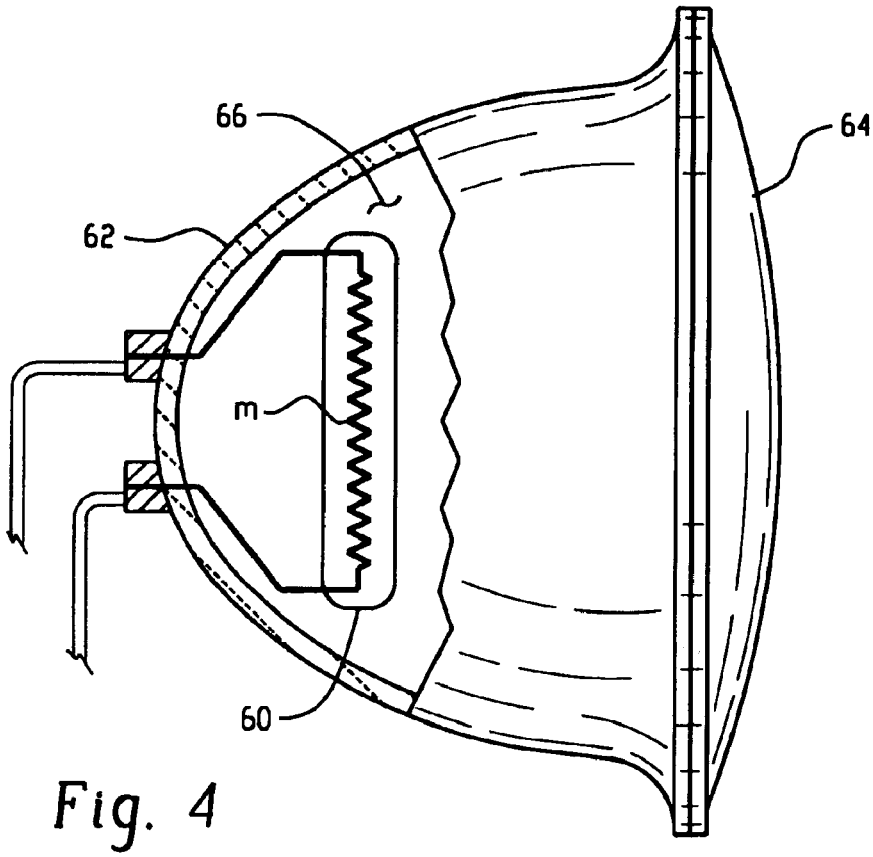

FIG. 4 demonstrates a prior art incandescent reflector lamp similar to the PAR 36, PAR 38, and PAR 64 designs commercially available from General Electric company. These prior art designs include a filament light source 60 running perpendicular to the axis of a polycrystalline aluminum coated reflector housing 62 with a filament midpoint m positioned substantially on the focus of the parabola.

In this embodiment, the lens 64 is flame sealed to reflector housing 62 to create a hermetic chamber 66. The atmosphere or fill of chamber 66 preferably comprises at least one inert gas, such as krypton, helium, or nitrogen. A preferred chamber fill is selected from the noble gases, of which krypton is particularly preferred.

The design of the lamp as exhibited in FIGS. 1–3 has been found to increase the LPW of a reflector lamp. The silver coating achieves an increased reflectance of at least 10% over a traditional, polycrystalline aluminum coating. Furthermore, it has been unexpectedly discovered that protecting the silver 14 with a silica overlayer 16 allows flame sealing of the lens 22, which is a traditional and necessary step in the manufacture of incandescent reflector lamps. Moreover, the high temperatures and exposure to oxygen have heretofore made a silver coating unsuitable for this application.

In addition, the unique position of the light generating filament in the present design such that the longitudinal axis of the filament now lies parallel to the central axis of the parabola with the filament midpoint outward from the focus of the parabola, reduces the amount of light reflectance occurring within the lamp and achieves more single reflection of light rays from the lens. This is significant because, even though silver is a more efficient reflector of light than polycrystalline aluminum, a certain portion of light energy is lost on each reflection.

While a longitudinal filament is preferred, it should be appreciated that the protected silver coating 14 may also be employed in lamps with a perpendicular filament, such as the design of FIG. 4.

Figure 5:
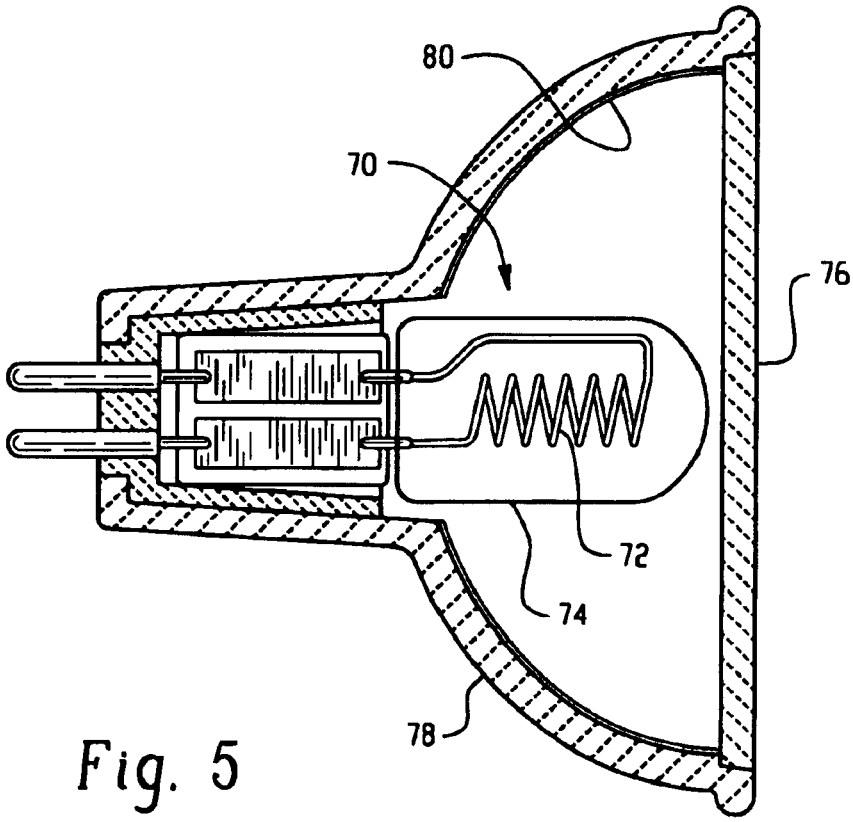
FIG. 5 is a cross-section of a halogen lamp in accordance with the present invention.

Referring now to FIG. 5, a lamp in accord with the invention is shown with a tungsten-halogen light source 70. In this embodiment, the light source filament 72 is housed in its own contained atmosphere within an envelope 74. Accordingly, a flame seal of a lens 76 to a reflector housing 78 is not required. Moreover, in this instance, the lens 76 can be adhesively secured to the reflector housing 78 since a hermetic seal is not required to preserve the filament integrity. This type of design is shown in U.S. Pat. No. 4,959,583, herein incorporated by reference. The housing includes an interior coating 80, which is formed in the same manner as coating 13 of FIGS. 1–3.

The avoidance of flame-sealing in the embodiment of FIG. 5 does not diminish the significance of the invention, since the silica coating of this embodiment protects the reflective silver coating against sulflating of the silver and the resultant destruction of the reflective properties of the coating.

In the preferred lamp, the coating 13 is prepared in three steps, the first step being the deposition of the silver layer 14, the second comprising the deposition of the buffer layer 18, and the third, the deposition of the protective, outer layer 16. The process will be described with particular reference to a silicon buffer layer and a silica protective layer, although it should be appreciated that other elements and oxides may be employed, as described above, or the buffer layer eliminated.

Figure 6:
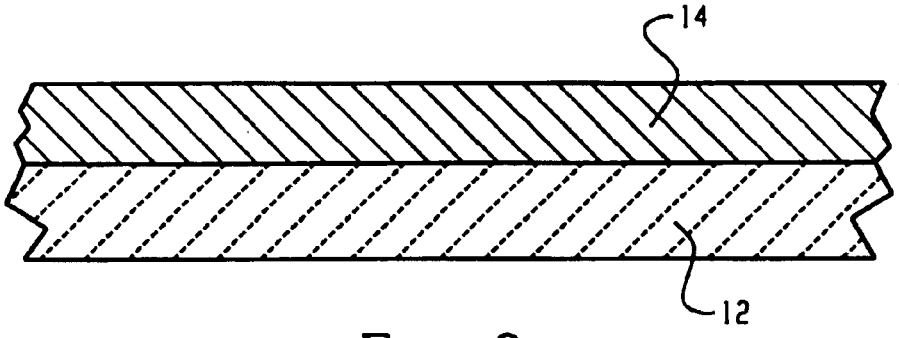
FIG. 6 is an enlarged cross-sectional view of a reflector housing after deposition of a reflective coating.

With reference to FIG. 6, the layer of silver is first deposited on the interior surface of the glass or quartz housing 12 of the reflector to a thickness of between about 0.1 to 0.6 micrometers in thickness, more preferably, from 0.2 to 0.4 micrometers in thickness. The silver layer is preferably deposited by vacuum deposition methods, such as sputtering, Ion-Assisted-Deposition (IAD), physical vapor deposition (PVD) or chemical vapor deposition (CVD), or by other known processes, such as thermal evaporation or dip coating.

Magnetron sputtering is one preferred method. In this process, a high energy inert gas plasma is used to bombard a target, such as silver. The sputtered atoms condense on the cold glass or quartz housing. DC (direct current) pulsed DC (40–400 KHz) or RF (radio frequency, 13.65 MHz) processes may be used, with RF or pulsed DC being preferred.

Ion assisted deposition is another method of depositing silver. An ion beam is used in combination with a deposition technique, such as PVD Electron beam evaporation. The ion beam (e.g., produced by a Kaufman Ion gun, available from Ion Tech Inc.) is used to bombard the surface of the deposited film during the deposition process. The ions compact the surface, filling in voids, which could otherwise fill with water vapor and damage the film during subsequent heating steps. This technique is relatively complex and more difficult to control than standard sputtering techniques.

Figure 7:
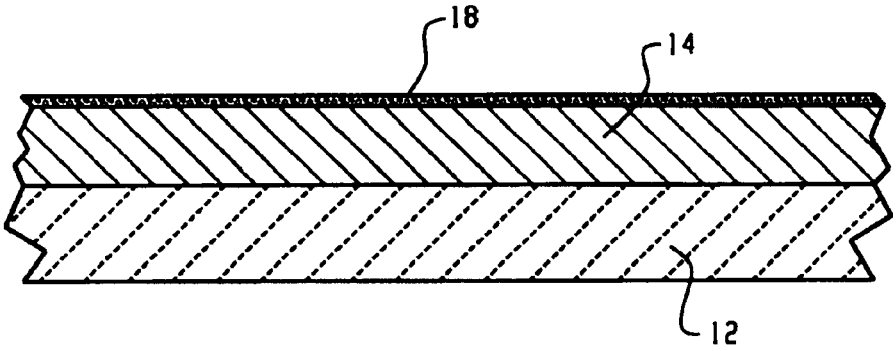
FIG. 7 is a cross-sectional view of the reflector housing of FIG. 6 after deposition of a buffer layer.

With reference to FIG. 7, a thin buffer layer 18 is then deposited on the silver. This is preferably achieved by one of the methods discussed above for deposition of the silver layer. Sputtering is a preferred method. For example, the silver target is replaced by a silicon target and a layer of silicon is sputtered on to the silver layer in the same deposition chamber.

The buffer layer protects the silver from oxidation during deposition of the protective layer 16 and is preferably formed from the same element as is used to form the oxide used to form the protective layer. For example, where the protective layer is $SiO_2$, a preferred buffer layer includes silicon. Likewise, for $TiO_2$, a preferred buffer layer includes titanium. The use of the same element minimizes the number of elements to be sputtered in vacuum sputtering, or evaporated in thermal evaporation during formation of the coating. However, by adding an additional target, the buffer layer can be formed of a different element to the oxide layer 16. For example, a buffer layer of silicon could be used with a protective layer of $TiO_2$, and so forth.

The buffer layer 18 is preferably sufficiently thin that it is consumed (i.e., converted to its oxide) in its entirety, or mainly consumed, during the third step of depositing the outer, protective layer 16. Accordingly, the buffer layer is preferably formed from an element, or elements, which is readily converted to a corresponding, stable oxide under the conditions used for depositing the protective layer. If the buffer layer is not totally consumed, it is sufficiently thin that the silver reflectivity is not adversely affected. During the third step, the buffer layer is preferably converted to the oxide form by oxygen present in the system for forming the outer, oxide layer 16. The buffer layer is sufficiently thick, however, that it protects the silver from oxidation by energetic oxygen ions present in the system in the third step. Accordingly, the buffer layer is preferably between 0.003 and 0.01 micrometers in thickness. For silicon, a particularly preferred thickness is about 0.004 micrometers and for titanium, a particularly preferred thickness is about 0.006 micrometer.

Figure 8:
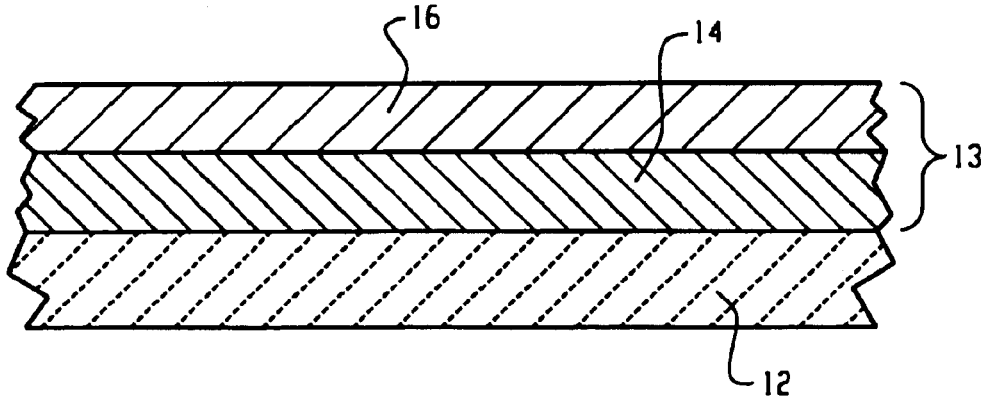
FIG. 8 is a cross-sectional view of the reflector housing of FIG. 6 after deposition of a protective layer.

With reference to FIG. 8, the protective layer 16 is deposited over the buffer layer 18. This is preferably achieved by one of the methods discussed above for deposition of the silver layer. Magnetron sputtering is a preferred method. In this method, oxygen gas is first introduced to the vacuum chamber. Some of the oxygenis converted to ions, and begins to attack the buffer layer 18. Sputtering of an element, such as silicon or titanium, is commenced. In the case of silicon, for example, the sputtered silicon combines with unreacted oxygen to form silica, which is deposited on what remains of the buffer layer 18. The buffer layer is thick enough that it is not totally consumed before silica deposition commences. However, as shown in FIG. 8, the buffer layer 18 is preferably all converted to its oxide, and thus forms part of the protective layer 16, by the time the deposition of the protective layer is complete.

The protective layer 16 of silica, or other oxide, preferably has a thickness of between about 0.05 and about 0.4 micrometers, most preferably, around 0.05–0.14 micrometers. This is thick enough to protect the silver against oxidation during formation of the lamp and against subsequent degradation by atmospheric sulfides.

U.S. Pat. Nos. 4,663,557; 4,833,576; 4,006,481; 4,211,803; 4,393,097; 4,435,445; 4,508,054; 4,565,747; and 4,775,203 all represent acceptable processes with which to deposit the silver and silica, and are herein incorporated by reference.

Silica and other oxide coatings produced by conventional deposition techniques tend to be oxygen deficient, i.e., have a stoichiometry of $SiO_x$, where $1 \leqq x \leqq 2$ (typically, x is between about 1.5 and 1.9). The refractive index of $SiO_x$ is larger than that of $SiO_2$, resulting in a less than optimal reflectivity of the lamp. It is thought that the oxygen deficiency is a result of low mobility of silicon and oxygen atoms on a silver or buffer layer substrate. The oxygen-deficient film tends to have a columnar microstructure, with numerous voids between the columns and is not as dense as stoichiometric $SiO_2$. Voids in the film may fill with water vapor. The water tends to evaporate when the film is heated during subsequent processing steps, damaging the integrity of the film. Accordingly, it is desirable to use a process which provides stoichiometric $SiO_2$, i.e., one which provides a value of x as close as possible to 2, and a dense structure.

One way to provide a stoichiometric $SiO_2$ film is to employ a deposition. process, such as Ion-Assisted-Deposition, which favors the deposition of a dense, stoichiometric film, by increasing the mobility of the condensed atoms. Alternatively, the glass or quartz substrate (housing) may be heated during deposition to increase the atom mobility. In this method, the housing is preferably heated to a temperature in the range of about 200–300° C. during $SiO_2$, deposition. Above about 350° C., it is difficult to achieve high vacuum suitable for deposition of the silica. While increasing the oxygen content of the $SiO_x$ this method still tends to leave a columnar structure with some voids.

Optionally, this method is used in combination with IAD to increase oxygen content and reduce voids at the same time.

In a preferred method for increasing the stoichiometry, the protective layer 16 of silica, or other oxide, is subjected to a temperature of at least 400° C. after deposition, more preferably to a temperature of 600° C., or more to improve the reflectivity of the protective layer. This allows conventional sputtering processes to be used for forming the protective layer.

The heating, or annealing process preferably takes place during one of the lamp fabrication steps, such as during the preheating and or tubulation steps. Accordingly, the protective layer 16 is formed prior to the annealing step or steps. This is contrary to conventional lamp forming processes in which an aluminum reflective coating is applied after tubulation.

A preferred lamp manufacturing process for IBM annealing the protective layer is as follows. First, the housing is coated with the silver layer. Then, the buffer layer is formed on the silver layer. Then, the protective layer is formed, by conventional techniques, such as sputtering. The coated lamp housing is then heated to raise the temperature of the housing slowly, without cracking, to a suitable temperature at which conventional tubulation processes may be employed. During tubulation, a natural gas flame or other suitable heating source, heats the base of the lamp to melt the glass or quartz sufficiently to insert and seal the ferrules 34, 36 and optionally an exhaust tube, if used, to the base of the lamp. The natural gas or other heat source used in tubulation heats the protective layer over the entire housing to around 800–1000° C.

The oxygen from the flame and from the surrounding air diffuses into the oxygen deficient protective layer 16 filling voids in the protective layer and increasing its density, resulting in increased reflectivity of the lamp. Reflectance of the lamp is increased by 2–3%, as compared with lamps in which the protective layer is not annealed.

Alternatively, the coating is formed after tubulation and is annealed in a separate process by heating the lamp to a temperature of around 600° C., or above. This adds an extra step to the lamp manufacture process.

During sealing of a cover lens to the housing, heat is also applied to the housing. While the temperature of the housing in the rim area may be high enough to anneal the silica layer in a localized region, the remainder of the housing does not generally reach a sufficiently high temperature to oxidize fully the silica. Temperatures at the base of the lamp generally reach only about 300° C. during sealing the lens.

In its preferred form, the lamp of the present invention will achieve a light output of at least 14 lumens per watt. Annealing of the silica protective layer increases the lumen output of the lamp by about 4 percent, as compared with a lamp in which the protective layer has not been annealed.

While the lamp has been described with particular reference to incandescent lamps and halogen tungsten lamps, it should be appreciated that other light sources may also be utilized with the present invention, including ceramic metal halide lamps.

Additionally, other reflective coatings could be used in place of silver, including alloys of silver and other metals. While aluminum could be used in place of silver, it has a melting point of 660° C., and thus will vaporize if a natural gas flame is used for the annealing process.

The invention will be further understood by reference to the examples below. These examples are intended to be utilized to more fully describe the invention and are not provided to limit the scope of this invention in any manner.

EXAMPLES

Example 1

Lamps having silver/silica coatings with axial or perpendicular filament alignments were compared with similar lamps with polycrystalline aluminum coatings.

Also compared were argon versus krypton environments. These results are shown in TABLE 1.

TABLE 1

| | At Coating | | Silver & Silica Coating | |
|---|---|---|---|---|
| | Perpendicular Light Source | Axial Light Source | Perpendicular Light Source | Axial Light Source |
| Ar Environment | N = 7<br>LPW = 12.2 | N = 9<br>LPW = 12.0<br>−1.6% | N = 5<br>LPW = 13.7<br>12.3% | N = 8<br>LPW = 14.3<br>17.2% |
| Kr Environment | N = 16<br>LPW = 12.4 | N = 6<br>LPW = 12.7<br>4.1% | N = 15<br>LPW = 14.0<br>14.8% | N = 5<br>LPW = 14.3<br>17.2% |

N = number of samples
LPW = lumens per watt
% = % change in lumens per watt over the corresponding Al coated lamp with perpendicular light source.

Example 2

An additional set of incandescent lamps were assembled to compare silver versus aluminum coatings in perpendicular and axial filament alignments. An additional comparison was made between an axial filament positioned with a midpoint on the focus and a filament midpoint disposed 15cm toward the lens from the midpoint. The results of the tests are shown in TABLE 2.

TABLE 2

| | TEST #2 | | |
|---|---|---|---|
| | Perpendicular Light Source | Axial Light Source | Axial Light Source Disposed 6 mm Outwardly From Focus |
| Al | N = 29<br>LPW = 11.29<br>0% | N = 27<br>LPW = 11.56<br>2.4% | |
| Ag | N = 29<br>LPW = 13.3<br>17.8% | N = 31 17.4%<br>LPW = 13.57<br>20.2%<br>2% | N = 16<br>LPW = 14.05<br>24.4%<br>3.5%<br>5.6% |

N = number of samples
LPW = lumens per watt
% = % change in lumens per watt over the corresponding Al coated lamp with perpendicular light source.

The results shown in TABLES 1 and 2 clearly demonstrate that silver is a far more efficient reflector in the lamps. The test resuIts also show-that an axial filament alignment is at least about 2% more efficient as compared to the traditional perpendicular filament alignment. In addition, the displacement from the focus has been shown to increase LPW by at least 3.5%.

Example 3

Silicon wafers were sputtered with a thin film of silicon dioxide and mounted to the interior surface of a PAR reflector housing. The refractive index of the coated wafers was measured with a Rudolph Research Ellipsometer, both before and after annealing of the reflector housing, at three different wavelengths. tempertures of the wafers during annealing were from 800–1000° C. The results are shown in TABLE 3. Thicknesses and positioning of the samples tested were as follows:

Sample 1: about 1400Å thickness

Sample 2: 1303–1476Å thickness (mounted near edge of PAR reflector)

Sample 3: 1080–1234Å thickness (mounted near center of PAR reflector)

TABLE 3

| Sample | Measurement Wavelength (Angstroms) | Refractive Index on Deposition | Refractive Index After Annealing |
|---|---|---|---|
| 1 | 6328 | 1.481 | 1.451 |
| 1 | 5461 | 1.482 | 1.461 |
| 1 | 4050 | 1.513 | 1.467 |
| 2 | 6328 | 1.486 | 1.449 |
| 2 | 5461 | 1.487 | 1.454 |
| 2 | 4050 | 1.523 | 1.466 |
| 3 | 6328 | 1.482 | 1.452 |
| 3 | 5461 | 1.491 | 1.455 |
| 3 | 4050 | 1.504 | 1.468 |

Measurement error was ±0.002.

As can be seen from TABLE 3, the refractive indexes of the samples were all decreased by annealing, to approximately that of a stoichiometric $SiO_2$ layer (about 1,45–1.46 in the visible region of the spectrum). Thus, it appears that the annealed silica film is fully oxidized, even at points on the housing furthest from the tubulation area (sample 2). The reflectance increases as the refractive index decreases, thus improved lamp performance is expected.

Example 4

Coatings on quartz substrates were prepared by depositing a silver film, forming a silicon barrier layer, and sputter-depositing a silicon dioxide protective layer, as described above. One sample, sample A, was flame annealed, while another sample, sample B,. was not. A visible difference was noted in the annealed coating, A. It had a whiter appearance than the yellowish, un-annealed sample B.

Figure 9:
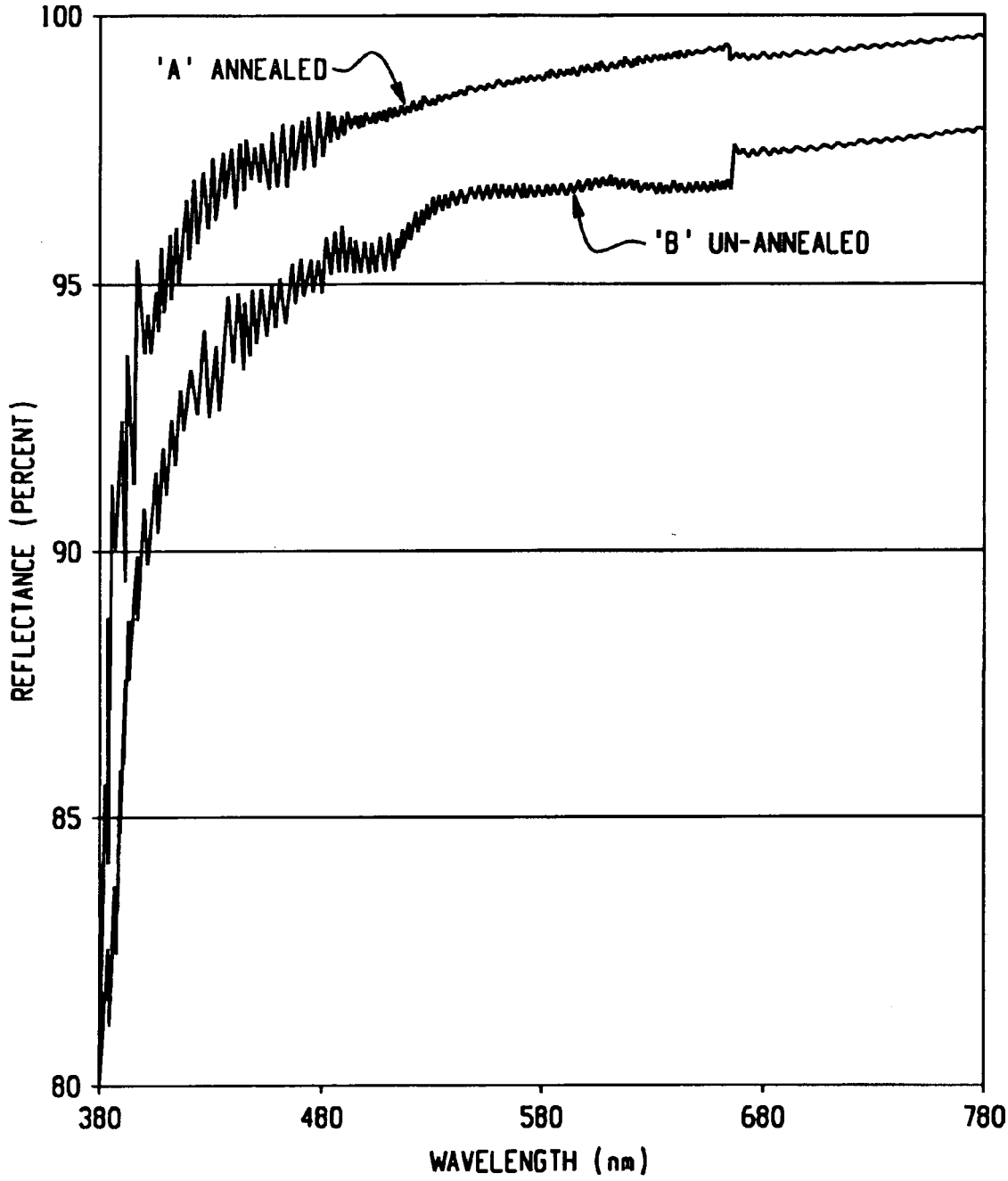
FIG. 9 is a plot of percentage reflectance vs wavelength for silver/silicon dioxide coated lamps with and without flame annealing.

FIG. 9 shows the difference in reflectivity of the two samples, A and B. As can be seen, the annealing process increases the reflectance by about 2–3 percent over a wide range of wavelengths. The annealed sample A has a reflectance of over 98% in the visible range of the spectrum. Lamps formed with the annealed protective layer 16 have a lumen output about 4 percent higher than non-annealed equivalents.

Thus, it is apparent that there has been provided in accordance with the invention, a reflective lamp that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and broad scope of the appended claims.

What is claimed is:

1. A method of forming a lamp comprising:

providing a reflective interior surface consisting of:

providing a layer of silver which reflects visible light, said layer of silver being between about 0.1 and about 0.6 micrometers in thickness, providing a protective layer which protects the silver layer against oxidation and sulfide formation, the protective layer being selected from the group consisting of silicon dioxide, titanium dioxide, aluminum oxide, and combinations thereof, and forming the lamp from the interior surface, a lens, and a light source, the lens transmitting visible light from the light source which is reflected by the reflective interior surface.

2. A method of forming a lamp comprising:

providing a reflective interior surface consisting of:

providing a layer of silver, providing a protective layer which protects the silver layer against oxidation and sulfide formation, providing a buffer layer intermediate between the layer of silver and the protective layer which protects the silver layer from oxidation during the step of providing the protective layer; and forming the lamp from the interior surface and a light source.

3. The method of claim 2, wherein said layer of silver is between about 0.1 and about 0.6 micrometers in thickness.

4. The method of claim 3, wherein the step of providing the buffer layer includes:

depositing a chemical element on the layer of silver, the chemical element being selected from the group consisting of silicon, tantalum, titanium, and combinations thereof.

5. The method of claim 3, wherein said buffer layer is up to about 0.01 micrometer in thickness.

6. The method of claim 3, wherein said protective layer is selected from the group consisting of silicon dioxide, titanium dioxide, aluminum oxide, and combinations thereof.

7. The method of claim 4, wherein the step of providing the protective layer includes:

introducing oxygen in the presence of the buffer layer;

sputtering a second chemical element which reacts with the oxygen form an oxide of the second chemical element; and depositing the oxide on to the buffer layer.

8. The method of claim 7, wherein the second chemical element is the same as the first chemical element.

9. The method of claim 7, wherein the step of providing the protective layer further includes:

consuming the buffer layer.

10. The method of claim 6, wherein said protective layer is silica and is between about 0.05 and about 0.14 micrometers in thickness.

11. The method of claim 3, wherein said step of forming the lamp includes:

flame sealing a lens to a housing, the housing supporting the reflective interior surface.

12. The method of claim 3, further including:

heating the protective coating to a temperature of at least 400° C.

13. The method of claim 12, further including:

heating the protective coating to a temperature of at least 600° C.

14. The method of claim 12, wherein the step of heating includes:

annealing the interior surface with a flame during tubulation of the lamp.

15. A method of forming a reflective coating for a lamp, the method comprising:

forming a layer of a reflective material on a substrate;

forming a protective coating over the layer, the protective coating including an oxide; and annealing the protective coating to increase reflectance of light by the coating.

16. The method of claim 15, wherein the reflective material includes silver.

17. A lamp comprising:

a housing;

a light source within the housing;

a reflective interior surface on the housing including:

a silver layer, and a protective layer disposed over the sliver layer;

a layer intermediate the housing and the reflective interior surface; and a lens closing the housing.

18. The lamp of claim 17, wherein the protective layer is selected from the group consisting of silicon dioxide, titanium dioxide, aluminum oxide, and combinations thereof.

19. The lamp of claim 17, wherein the intermediate layer is selected from the group consisting of chromium and nickel.

20. A method of forming a lamp comprising:

providing a reflective interior surface with a reflectance of over 95% in the visible range of the spectrum consisting of:

providing a reflective layer of silver which reflects visible light, providing a protective layer whith protects the reflective silver layer against oxidation and sulfide formation, the protective layer being formed from an oxide of silicon; and forming the lamp from the interior surface and a light source.

* * * * *